United States Patent [19]

Wharton

[11] Patent Number: 4,644,231

[45] Date of Patent: Feb. 17, 1987

[54] VIDEO DATA DISPLAY DRIVER STAGE

[75] Inventor: James H. Wharton, Indianapolis, Ind.

[73] Assignee: RCA Corporation, Princeton, N.J.

[21] Appl. No.: 674,989

[22] Filed: Nov. 29, 1984

[51] Int. Cl.[4] ..... H01J 29/52

[52] U.S. Cl. ..... 315/383; 358/169

[58] Field of Search ..... 315/383; 358/168, 169

[56] References Cited

U.S. PATENT DOCUMENTS 3,804,981 4/1974 Avins ..... 358/169

FOREIGN PATENT DOCUMENTS 856016 12/1960 United Kingdom ..... 358/169

OTHER PUBLICATIONS

Schematic Circuit Diagram of Panasonic Monochrome Video Monitor Model No. K-701T5.

Schematic Circuit Diagram of IBM Color Video Monitor No. 5153.

*Primary Examiner*—Theodore M. Blum

*Attorney, Agent, or Firm*—P. J. Rasmussen; P. M. Emanuel; R. H. Kurdyla

[57] ABSTRACT

In a video monitor for display alphanumeric data on a kinescope display screen, a kinescope driver transistor receives binary video data signals at a low impedance emitter input electrode and provides high level video data output signals to the kinescope from a collector output electrode. A source of adjustable control voltage is coupled to the base electrode of the driver transistor for varying the intensity of the data display.

6 Claims, 1 Drawing Figure

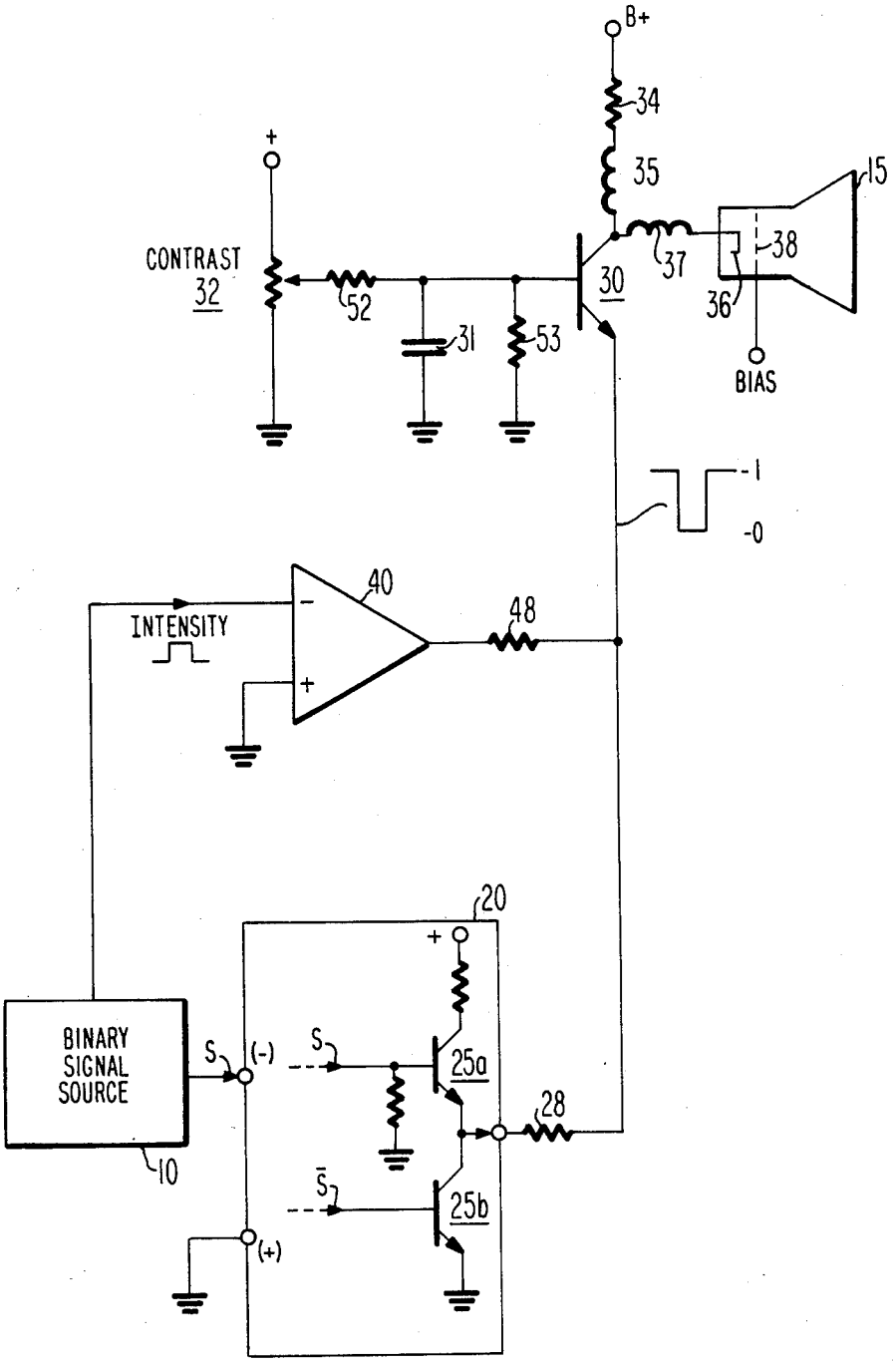
B+
34
35
15
CONTRAST
32
52
31
53
30
37
38
36
BIAS
-1
-0
40
INTENSITY
48
20
BINARY
SIGNAL
SOURCE
10
S
(-)
S
25a
28
S̄
25b
(+)

VIDEO DATA DISPLAY DRIVER STAGE

This invention concerns a video output display driver stage in a data display monitor system. In particular, this invention concerns such a driver stage associated with contrast control apparatus for controlling the intensity of images displayed by an image reproducing device such as a kinescope.

Video monitors for displaying data in the form of alphanumeric information include a video output display driver stage for providing high level video drive signals to an intensity control electrode (e.g., cathode) of an associated kinescope image display device. Video monitors used for data display purposes often exhibit a wide bandwidth, e.g., greater than 20 MHz, to achieve high resolution of displayed data. In order to achieve wide bandwidth operation the display driver stage of a wideband monitor often exhibits a smaller output impedance and a greater output current level compared to a driver stage in some other video display systems such as television receivers. Power consumption and output heating effects are therefore important considerations in many wideband video monitor designs.

Video monitors also commonly include apparatus for controlling the contrast of a displayed image by varying the amplitude of image representative video signals to make a displayed image appear more or less intense. Greater image contrast is usually required when the image is being viewed in bright ambient light, while less contrast is usually preferred in dim ambient light.

Accordingly, pursuant to the principles of the present invention there is disclosed herein an uncomplicated and inexpensive arrangement of a video output display driver stage and associated image contrast control apparatus, with reduced average power consumption and wideband capability, for use in a video data display system.

The disclosed arrangement in accordance with an implementation of the invention includes a video output display driver amplifier, a source of contrast control signal, and a source of binary video signals representative of information to be displayed by an image display device. The contrast control signal is applied to one input of the driver amplifier, the video signal is applied to another input of the amplifier, and amplitude controlled video signals are provided from an output of the driver amplifier to an intensity control electrode of the image display device.

In accordance with a feature of the invention a source of auxiliary control signals for controlling the intensity of a displayed image is coupled to the video signal input of the driver amplifier.

The sole FIGURE of the drawing shows a portion of video monitor including a display driver stage in accordance with the principles of the present invention.

A source 10 of binary signals, such as a computer terminal, provides a binary output signal S representative of alphanumeric data information to be displayed by a kinescope 15. Binary signal S is applied to an inverting input (−) of a differential amplifier 20 which includes a low impedance output circuit including transistors 25*a* and 25*b*. A non-inverting input (+) of amplifier 20 is coupled to signal ground. Complementary phased (push-pull) signal versions (S and S) of input signal S produced within amplifier 20 are applied to the base electrodes of transistors 25*a* and 25*b*. An amplified version of input signal S appears at the low impedance output of amplifier 20 at the interconnected emitter of transistor 25*a* and collector of transistor 25*b*. The latter signal is coupled via a resistor 28 to a low impedance emitter input of an NPN video output display driver transistor 30. Amplifier 20 serves to translate the signals from source 10 to a level compatible with the input drive requirements of transistor 30, and the low output impedance of amplifier 20 assists to prevent degradation of the high frequency characteristics of the signal applied to transistor 30.

A base input of transistor 30 is coupled to the wiper of a DC image contrast control 32 which is manually adjustable by a viewer to vary the intensity of a displayed image. A filter capacitor 31 is coupled from a wiper of control 32 to ground. The collector output of transistor 30 is coupled via a load resistor 34 and a high frequency peaking coil 35 to a source of high operating voltage B+. A high level amplified video output signal suitable for driving kinescope 15 is developed in the collector circuit of transistor 30 and is coupled via a high frequency peaking coil 37 to a cathode intensity control electrode 36 of kinescope 15. In this example kinescope 15 is a monochrome display device with a single electron gun comprising cathode 36 and a grid 38.

The intensity of a displayed image is also controllable in response to a binary INTENSITY signal, as will be discussed, which is developed by source 10 and coupled to the low impedance emitter input of display driver transistor 30 via an inverting amplifier 40 and a resistor 48. Amplifier 40 is similar to amplifier 20 and includes a low impedance output circuit (not shown). Integrated circuit type 74LS128, available from Texas Instruments Corp., contains amplifiers suitable for use as amplifiers 20 and 40.

Driver transistor 30 is rendered non-conductive when the binary signal applied to its emitter exhibits a relatively positive "1" logic level greater than the base potential of transistor 30. At this time the collector of transistor 30 is at B potential, and the display screen of kinescope 15 exhibits a black display. Transistor 30 is caused to conduct when the binary signal applied to its emitter exhibits a less positive "0" logic level, whereby light output is produced on the screen of kinescope 15. For this condition the current conducted by transistor 30 increases and the collector potential of transistor 30 decreases, and both vary in accordance with the setting of contrast control 32. Thus the binary information signal applied to the emitter of transistor 30 causes the collector potential of transistor 30 to vary between B+ and a lower potential determined by the setting of control 32.

Since driver transistor 30 is intended to be cut-off when the display screen is to be blanked, it is necessary at such times to force the emitter potential of transistor 30 above the base potential of transistor 30 in order to reliably reverse bias transistor 30. The low output impedance drive capability of amplifier 20 assists to meet this objective. Also, the disclosed driver stage including transistor 30 advantageously exhibits reduced average power consumption, e.g., compared to Class A output stages which are often employed in wideband systems, since driver transistor 30 operates between non-conductive and conductive states in response to the input binary information signal. The latter aspect of the disclosed arrangement permits a less costly, lower power transistor to be used for transistor 30.

Adjustment of contrast control 32 varies the intensity of the information being displayed by kinescope 15 between a maximum limit (white) and a minimum limit corresponding to a preselected shade of gray. The maximum and minimum limits are determined by resistors 52 and 53 in the base circuit of transistor 30, so that displayed information can exhibit a predetermined gray scale, or shades of gray to white, as control 32 is adjusted.

Contrast control via potentiometer 32 is advantageously accomplished by a DC control mechanism, wherein a wire connecting the wiper of potentiometer 32 to the base of transistor 30 does not conduct alternating current signals which could undesirably radiate high frequency interference components. The connection of viewer operated potentiometer 32, which may be situated on the front panel of the monitor, to transistor 30 may entail the use of a long wire susceptible of radiating such interference components, in addition to introducing additional parasitic capacitance capable of degrading high frequency signal characteristics in systems which convey alternating current information signals along such interconnecting wire.

The disclosed arrangement of contrast control 32 in association with display driver transistor 30 facilitates the design of a wideband video monitor system. Specifically, the disclosed contrast control arrangement minimizes the number of analog circuits which follow the contrast control and which must be designed to linearly accomodate variable amplitude signals in accordance with the setting of the contrast control. Thus the disclosed arrangement, which is uncomplicated and economical in itself, simplifies the design of associated system circuits and can lead to substantial cost savings and more reliable system operation particularly in a wideband video monitor which operates at very high frequencies.

The contrast control function is modified by means of the INTENSITY signal which, when coupled via amplifier 40 and resistor 48 to output transistor 30, causes a more intense (e.g., whiter-than-white) image display to result by causing the conduction of output transistor 30 to increase. This function can be advantageously used to highlight certain displayed information at given times. The amount of additional intensity imparted by the INTENSITY signal can be tailored by adjusting the values of resistors 28 and 48, which also serve as current limiting devices.

The disclosed display driver and contrast control arrangement can also be employed in a color monitor system. In such case plural display driver stages would be employed, one for each color channel, and the source of contrast control voltage would be coupled in common to control inputs of each driver stage.

What is claimed is:

1. In a video signal processing and display system including an image display device responsive to video signals applied to a signal input thereof, apparatus comprising:

a display driver amplifier having a first input terminal, a second input terminal, and a third output terminal for providing to said signal input of said display device video signals of a magnitude suitable for directly driving said display device, said first and third terminals defining a main current conduction path of said display driver amplifier;

a source of binary video signals representative of information to be displayed coupled to said first input terminal of said driver amplifier; and a source of image contrast control signal coupled to said second terminal of said driver amplifier for controlling the magnitude of the current conducted by said driver amplifier.

2. Apparatus according to claim 1, and further comprising a source of image intensity control signal coupled to said first terminal of said driver amplifier for providing additional control of the current conducted by said driver amplifier.

3. Apparatus according to claim 1, wherein said first input terminal exhibits a low impedance relative to said second and third terminals.

4. Apparatus according to claim 3, wherein said source of binary signals exhibits a low output impedance.

5. Apparatus according to claim 3, wherein said driver amplifier comprises a transistor with an emitter electrode corresponding to said first terminal, a base electrode corresponding to said second terminal, and a collector electrode corresponding to said third terminal.

6. Apparatus according to claim 1, wherein said driver amplifier operates between conductive and non-conductive states in response to said binary video signals.

* * * * *